US010557384B2

(12) United States Patent
Burke et al.

(10) Patent No.: US 10,557,384 B2
(45) Date of Patent: Feb. 11, 2020

(54) COUPLING FOR A CAMSHAFT PHASER ARRANGEMENT FOR A CONCENTRIC CAMSHAFT ASSEMBLY

(71) Applicant: Schaeffler Technologies AG & Co. KG, Herzogenaurach (DE)

(72) Inventors: Steven Burke, Fort Gratiot, MI (US); Jochen Thielen, Nürnberg (DE); Inhwa Chung, Lasalle (CA); Andrew Mlinaric, Lakeshore (CA); Donald Haefner, Troy, MI (US); Vaishnavi Pawade, Rochester Hills, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/193,130

(22) Filed: Nov. 16, 2018

(65) Prior Publication Data

US 2019/0368389 A1 Dec. 5, 2019

Related U.S. Application Data

(60) Provisional application No. 62/679,270, filed on Jun. 1, 2018.

(51) Int. Cl.
*F01L 1/34* (2006.01)
*F01L 1/344* (2006.01)

(52) U.S. Cl.
CPC ..... *F01L 1/34413* (2013.01); *F01L 1/3442* (2013.01); *F01L 2001/34496* (2013.01)

(58) Field of Classification Search
CPC ..... F01L 1/3442; F01L 1/047; F01L 1/026; F01L 1/352; F01L 1/022; F01L 1/024; F01L 1/053; F01L 2001/34493; F01L 2001/0473; F01L 2001/0535; F01L 2001/34489; F01L 2001/3521; F01L 2820/041; F01L 2820/032
See application file for complete search history.

(56) References Cited

U.S. PATENT DOCUMENTS

| | | | |
|---|---|---|---|
| 6,725,817 | B2 | 4/2004 | Methley et al. |
| 7,841,311 | B2 | 11/2010 | Hutcheson et al. |
| 8,051,818 | B2 | 11/2011 | Myers et al. |
| 8,191,521 | B2 | 6/2012 | Kandolf et al. |
| 8,201,528 | B2 | 6/2012 | Knecht et al. |

(Continued)

FOREIGN PATENT DOCUMENTS

| | | | |
|---|---|---|---|
| DE | 102009041755 | A1 | 4/2010 |
| DE | 102014212615 | A1 | 12/2015 |
| WO | 2017/042302 | A1 | 3/2017 |

*Primary Examiner* — Zelalem Eshete
(74) *Attorney, Agent, or Firm* — Matthew V. Evans

(57) ABSTRACT

A camshaft phaser arrangement configured for a concentric camshaft assembly having inner and outer camshafts is provided. The camshaft phaser arrangement includes a first camshaft phaser, a second camshaft phaser, a coupling, and at least one timing wheel connected to at least one of the first or second camshaft phaser. Each of the camshaft phasers is configured to be connected to either the inner or the outer camshaft. The coupling includes a coupling ring and at least one coupling pin that torsionally connects the first camshaft phaser to the second camshaft phaser. The coupling provides for radial and axial movement between the first camshaft phaser and the second camshaft phaser.

20 Claims, 6 Drawing Sheets

(56) References Cited

U.S. PATENT DOCUMENTS

| | | | | |
|---|---|---|---|---|
| 8,371,257 | B2 * | 2/2013 | Moon | F01L 1/3442 123/90.15 |
| 8,887,676 | B2 | 11/2014 | Methley et al. | |
| 9,080,474 | B2 | 7/2015 | Wigsten et al. | |
| 9,366,159 | B2 | 6/2016 | Birman et al. | |
| 2010/0089353 | A1 | 4/2010 | Myers et al. | |
| 2010/0186698 | A1 | 7/2010 | Pluta | |
| 2018/0274400 | A1 | 9/2018 | Berwinkl et al. | |

* cited by examiner

COUPLING FOR A CAMSHAFT PHASER ARRANGEMENT FOR A CONCENTRIC CAMSHAFT ASSEMBLY

CROSS-REFERENCE TO RELATED APPLICATIONS

This application claims the benefit of U.S. Provisional Patent Application No. 62/679,270 filed Jun. 1, 2018, the disclosure of which is incorporated in its entirety by reference herein.

TECHNICAL FIELD

Example aspects described herein relate to couplings for camshaft phasers, and, more particularly, to camshaft phasers utilized within an internal combustion (IC) engine having a concentric camshaft assembly.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. Electric camshaft phasers can be configured with a gearbox and an electric motor to phase a camshaft to achieve variable engine valve timing.

Many different camshaft configurations are possible within an IC engine. Some camshaft configurations include an intake camshaft that only actuates intake valves, and an exhaust camshaft that only actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes proves difficult to provide independent phasing of the intake and exhaust valves. For single camshaft configurations, a concentric camshaft assembly can be implemented that utilizes an inner camshaft and an outer camshaft, each arranged with one of either exhaust lobes or intake lobes, with each of the camshafts having a designated camshaft phaser to vary the respective engine valve timing.

One known camshaft phaser arrangement for a concentric camshaft assembly includes a first and a second camshaft phaser that are stacked coaxially at an end of the concentric camshaft assembly. A solution is needed that facilitates connection of this camshaft phaser arrangement to the concentric camshaft assembly while torsionally or rotationally coupling the two camshaft phasers to a crankshaft of the IC engine.

SUMMARY

A camshaft phaser arrangement configured for a concentric camshaft assembly having inner and outer camshafts is provided. The camshaft phaser arrangement includes a first camshaft phaser, a second camshaft phaser, and a coupling arranged to torsionally connect the first camshaft phaser to the second camshaft phaser. Each of the camshaft phasers is configured to be connected to either the inner or the outer camshaft. The coupling includes a coupling ring and at least one coupling pin. The coupling ring has at least one first radial slot and at least one second radial slot. The at least one first radial slot is configured to: (1) connect the coupling ring to one of the first or second camshaft phaser, and (2) provide for a first radial movement between the first camshaft phaser and the second camshaft phaser. A pathway for the first radial movement can be defined by the at least one first radial slot. The at least one second radial slot is configured to provide for: (1) a second radial movement the first camshaft phaser and the second camshaft phaser, and, (2) an axial movement between the first camshaft phaser and the second camshaft phaser. A pathway for the second radial movement can be defined by the at least one second radial slot. The at least one coupling pin has a first end that is received by the at least one second radial slot, and a second end that is connected to the other of the first or second camshaft phaser.

A diameter of the first end of the at least one coupling pin can be smaller than a width of the at least one second radial slot. In one embodiment, the at least one coupling pin is connected to a non-phased component of the second camshaft phaser, such as a stator. The stator can be arranged with an aperture that receives the at least one coupling pin.

A center line of the at least one first radial slot can be perpendicular to a center line of the at least one second radial slot.

The at least one first radial slot can include a first pair of opposed radial slots, and the at least one second radial slot can include a second pair of opposed radial slots.

At least one fastener can connect the coupling ring to the one of the first or second camshaft phaser. At least one bushing can be connected to the one of the first or second camshaft phaser by the at least one fastener, with the at least one bushing being received by the at least one first radial slot. A length of a body of the at least one bushing can be greater than a height of the at least one first radial slot, and a diameter of the body of the at least one bushing can be less than a width of the at least one first radial slot.

The coupling ring can be connected to the first camshaft phaser, and the second end of the at least one coupling pin can be connected to the second camshaft phaser, the first camshaft phaser arranged axially outward of the second camshaft phaser. In one example embodiment, the coupling ring is formed with an axial offset. The coupling ring can be connected to a non-phased component of the first camshaft phaser.

At least one of the first or second camshaft phaser can be an electric camshaft phaser or a hydraulic camshaft phaser. Furthermore, the first camshaft phaser can be an electric camshaft phaser that is configured to be connected to the inner camshaft, and the second camshaft phaser can be a hydraulic phaser configured to be connected to the outer camshaft. In this instance, the coupling ring can be connected to an outer collar of the first camshaft phaser.

The second camshaft phaser can include a drive wheel that is configured with a powertrain interface.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
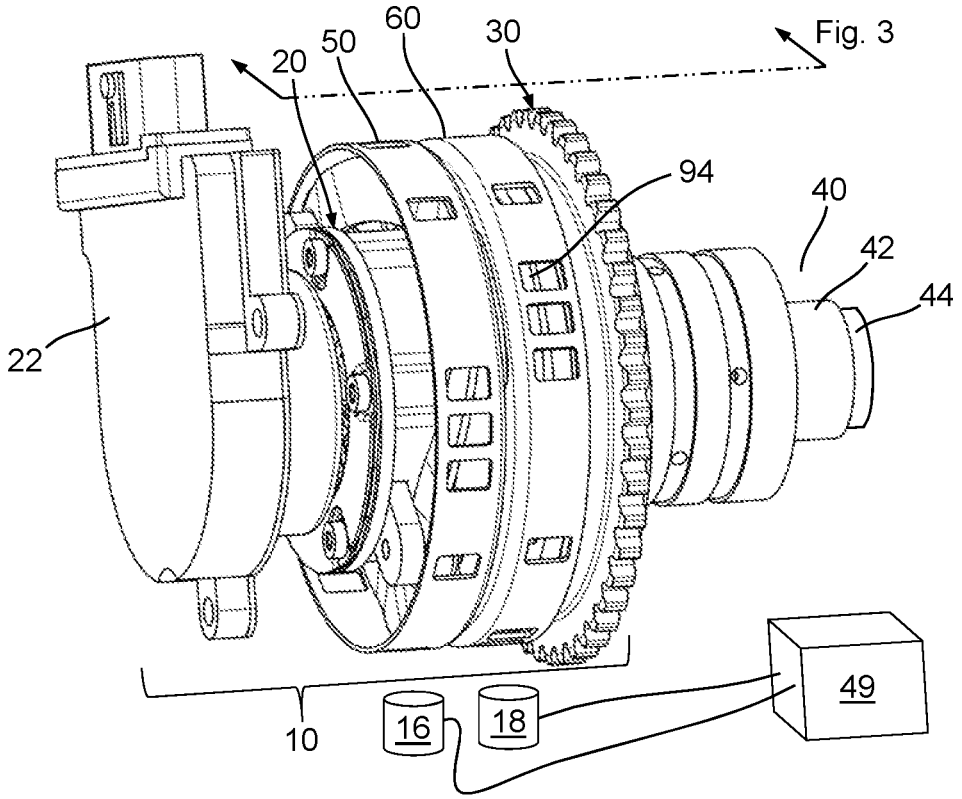
FIG. 1 is a perspective view of a camshaft phaser arrangement for a concentric camshaft assembly that includes a first camshaft phaser with a first timing wheel and a second camshaft phaser with a second timing wheel.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
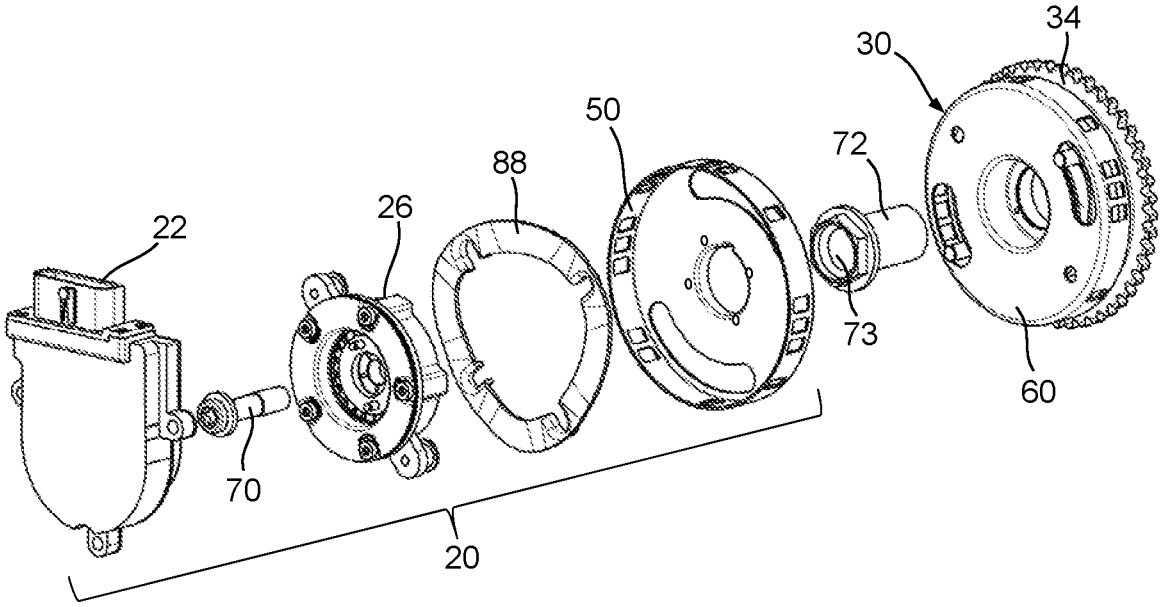
FIG. 2 is an exploded perspective view of the camshaft phaser arrangement of FIG. 1.
Figure 3:
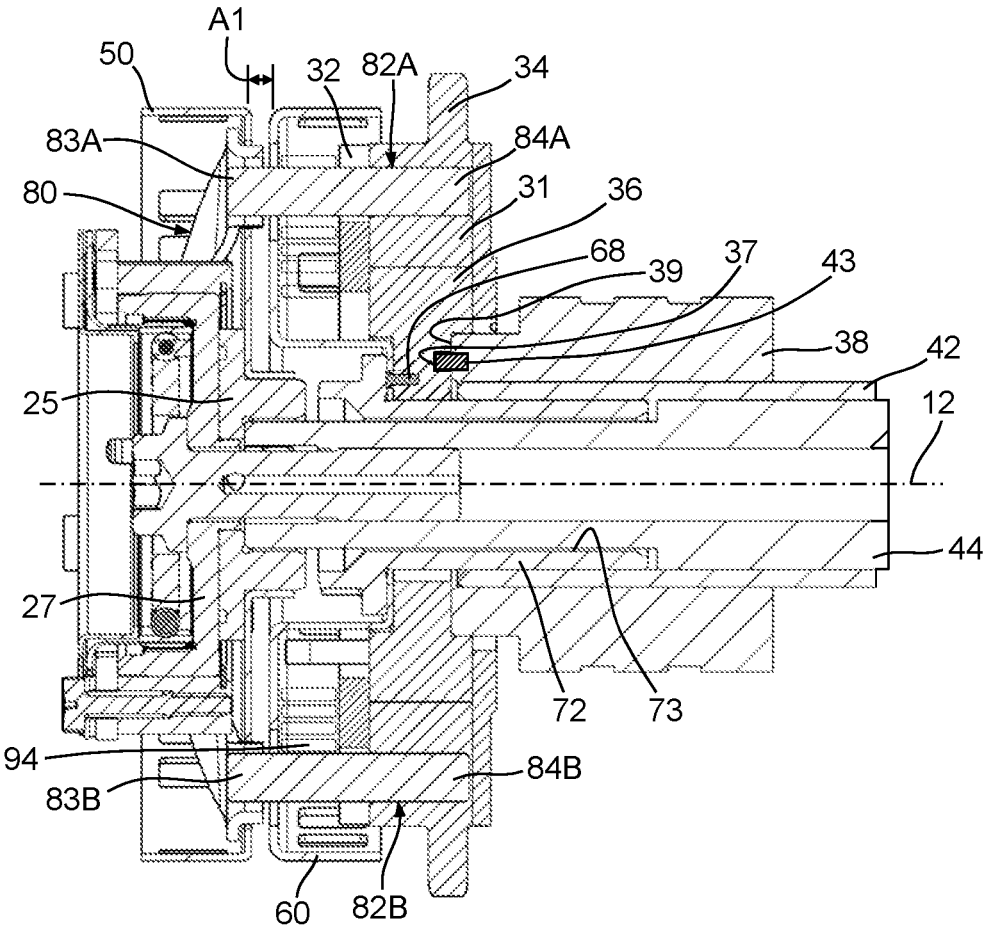
FIG. 3 is a cross-sectional view taken from FIG. 1.

Referring to FIG. 1, a perspective view of an example embodiment of a camshaft phaser arrangement 10 configured for a concentric camshaft assembly 40 is shown. FIG. 2 shows an exploded perspective view of the camshaft phaser arrangement 10 of FIG. 1. FIG. 3 shows a cross-sectional view taken from FIG. 1. The following discussion should be read in light of FIGS. 1 through 3. The camshaft phaser arrangement 10 includes a rotational axis 12, a first camshaft phaser 20, a second camshaft phaser 30, a first timing wheel 50, a second timing wheel 60, and a coupling 80 that torsionally couples the two camshaft phasers 20, 30. The first camshaft phaser 20 is arranged axially adjacent to the second camshaft phaser 30 such that the first camshaft phaser 20 is axially outward of the second camshaft phaser 30. Additionally, the first camshaft phaser 20 can be concentric with the second camshaft phaser 30, as shown. The concentric camshaft assembly 40 includes an outer camshaft 42 and an inner camshaft 44. The first camshaft phaser 20 is an electric camshaft phaser, actuated by an electric motor 22, and the second camshaft phaser 30 is hydraulically actuated; however, the first and second camshaft phasers 20, 30 could both either be electric camshaft phasers or hydraulic camshaft phasers; furthermore, the positions of the first and second camshaft phasers 20, 30 could be swapped, such that the second camshaft phaser 30 (hydraulic) is axially outward of the first camshaft phaser 20 (electric).

For the example embodiment shown in FIGS. 1 through 3, the inner camshaft 44 is connected to the first camshaft phaser 20 via a first camshaft fastener 70, and the outer camshaft 42 is connected to the second camshaft phaser 30 via a second camshaft fastener 72. The second camshaft fastener 72 has a longitudinal through-aperture 73 through which the inner camshaft 44 extends to facilitate connection with the first camshaft fastener 70. Therefore, the through-aperture 73 encloses a portion of the inner camshaft 44. It could also be possible to connect the inner camshaft 44 to the second camshaft phaser 30 and the outer camshaft 42 to the first camshaft phaser 20.

The coupling 80 includes coupling pins 82, fasteners 85, bushings 86, and a coupling ring 88. The coupling 80 can serve to torsionally couple the first and second camshaft phasers 20, 30, while permitting axial and radial movement between them. Given that the first camshaft phaser 20 is rigidly mounted to the inner camshaft 44, resultant axial and radial locations of the first camshaft phaser 20 vary due to manufacturing tolerances of several components, including, but not limited to the first camshaft phaser 20, the outer camshaft 42, the concentric camshaft assembly 40, and a housing (not shown), such as a cylinder head of an IC engine, that receives the concentric camshaft assembly 40. Furthermore, rigid mounting of the second camshaft phaser 30 to the outer camshaft 42, combined with component manufacturing tolerances, also varies the axial and radial locations of the second camshaft phaser 30.

In the example embodiment shown in FIGS. 1 through 5, the second camshaft phaser 30 includes a drive wheel 34 with a power transmission interface 35. The power transmission interface 35 can engage with either a belt, chain, gear or any power transmission component that connects the camshaft phaser arrangement 10 to a crankshaft (not shown) or any other power source within an IC engine.

Figure 5:
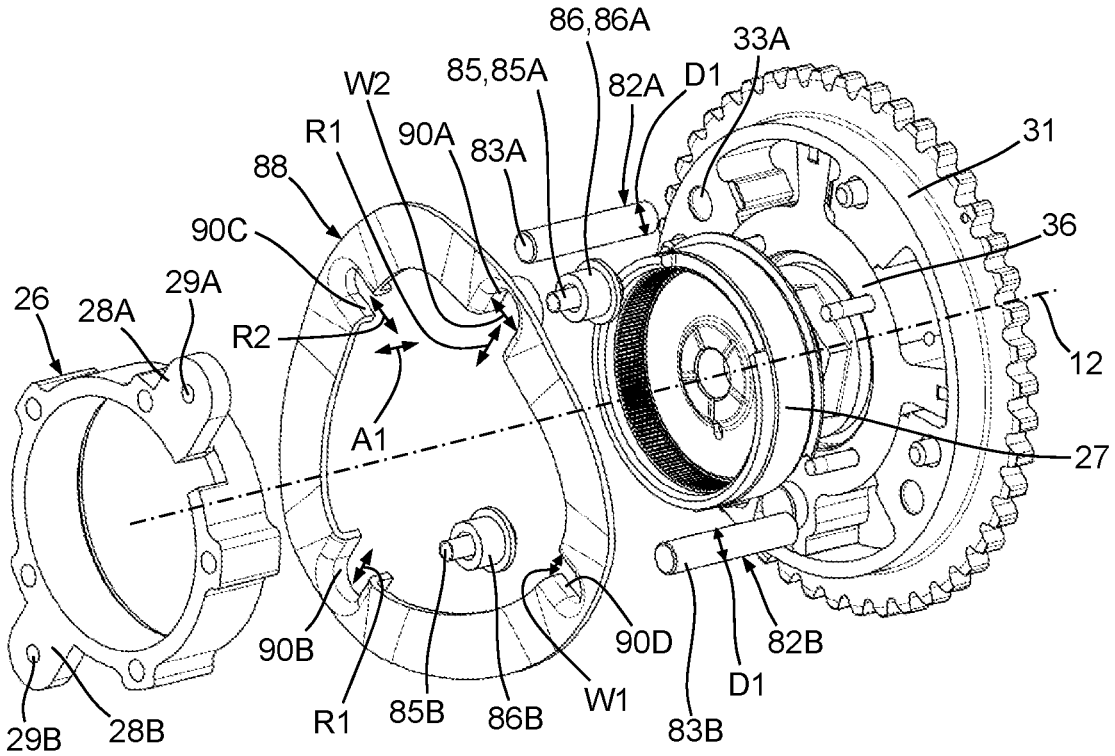
FIG. 5 is an exploded perspective view of FIG. 4 without a front cover of the second camshaft phaser for clarity purposes.
Figure 6A:
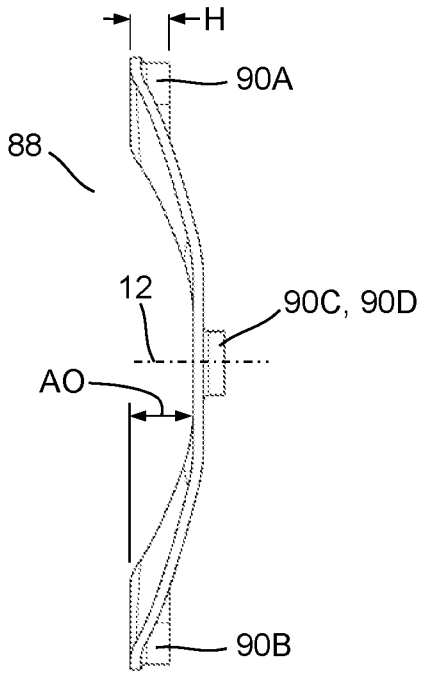
FIG. 6A is a side view of a coupling ring shown in FIG. 5.
Figure 6B:
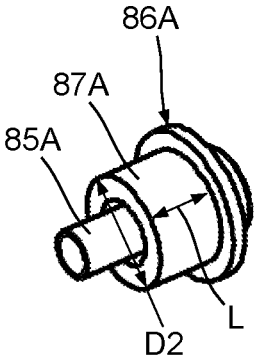
FIG. 6B is an isometric view of a bushing and fastener assembly shown in FIG. 5.

The coupling 80 facilitates a torsional connection between the drive wheel 34 and the first camshaft phaser 20. Stated more specifically, the coupling 80 facilitates a torsional connection between a stator 31 that is connected to the drive wheel 34 and an outer collar 26 of the first camshaft phaser 20. Both the stator 31 and the outer collar 26 can be classified as "non-phased" components; stated otherwise, these components typically rotate in-phase or in unison with the drive wheel 34. The coupling ring 88 is connected to the outer collar 26 in a way that permits radial movement of the coupling ring 88 relative to the outer collar 26. This can be accomplished via first and second bushings 86A, 86B that are attached to respective first and second protrusions 28A, 28B arranged on the outer collar 26 by respective first and second fasteners 85A, 85B that are received in respective first and second apertures 29A, 29B. The first and second bushings 86A, 86B are received by respective first and second radial slots 90A, 90B formed within the coupling ring 88. The first and second radial slots 90A, 90B can also be described as a first pair of "opposed" radial slots, designating that they are located 180 degrees apart (see FIG. 6C). Referring to FIGS. 6A and 6B that show a side view of the coupling ring 88 and an isometric view of the first bushing 86A, respectively, the first bushing 86A includes a body 87A having a length L and a diameter D2; the length L is greater than a height H of the first radial slot 90A, and the diameter D2 is less than a width W2 of the first radial slot 90A. When the coupling ring 88 is attached to the outer collar 26 via the first bushing 86A and the first fastener 85A, these dimensional relationships can facilitate a first radial movement of the coupling ring 88 relative to the outer collar 26. As the second bushing 86B and second radial slot 90B can have the same dimensional relationship (length of body>height of radial slot; diameter of body<width of radial slot), the first and second bushings 86A, 86B together with the first and second radial slots 90A, 90B provide for a first radial movement R1 of the coupling ring 88, as shown in FIG. 5. Stated otherwise, the first and second bushings 86A, 86B together with the first and second radial slots 90A, 90B provide for a first radial movement R1 between the first camshaft phaser 20 and the second camshaft phaser 30. A pathway for the first radial movement R1 is defined by the first and second radial slots 90A, 90B. Attachment of the coupling ring 88 to the first camshaft phaser 20 could be accomplished in other ways than the previously described bushing and fastener arrangement.

Referring to a first coupling pin 82A, a first end 83A is received by a third radial slot 90C formed in the coupling ring 88; furthermore, a first end 83B of a second coupling pin 82B is received by a fourth radial slot 90D formed in the coupling ring 88. The third radial slot 90C and the fourth radial slot 90D can also be described as a second pair of opposed radial slots that are formed on the coupling ring 88. The third radial slot 90C and the fourth radial slot 90D have a width W1 that is greater than a diameter D1 of the first and second coupling pins 82A, 82B; therefore, the third and fourth radial slots 90C, 90D can provide a second radial movement R2, and an axial movement μl, of the first end 83A of the first coupling pin 82A and the first end 83B of the second coupling pin 82B. A pathway of the second radial movement R2 is defined by the third and fourth radial slots 90C, 90D. A second end 84A of the first coupling pin 82A and a second end 84B of the second coupling pin 82B are connected to the stator 31 of the second camshaft phaser 30. For clarification, "connected to the stator 31" includes being directly connected to the stator 31 or any other non-phased component that is connected to the stator, such as a front cover 32 or the drive wheel 34. As shown, an interference fit between the second end 84A of the first coupling pin 82A and an aperture 33A within the stator 31 can facilitate this connection, however, other connection designs are also possible.

Figure 4:
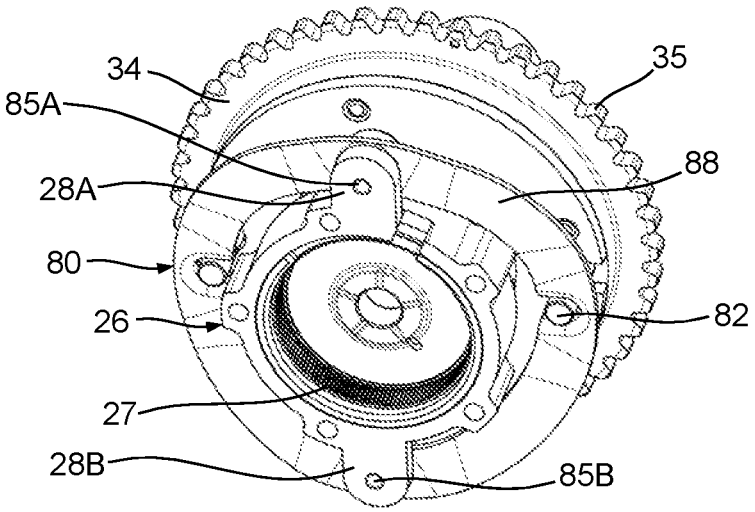
FIG. 4 is a partial perspective view of the camshaft phaser arrangement of FIG. 1 showing a coupling that torsionally connects the first camshaft phaser to the second camshaft phaser.

Referring to FIGS. 3 through 5, the coupling 80 fulfills a torsional connection role while permitting: 1). Axial movement μl between the first camshaft phaser 20 and the second camshaft phaser 30; and, 2). First and second radial movements R1, R2 between the first camshaft phaser 20 and the second camshaft phaser 30. The axial movement μl and the first and second radial movements R1, R2 can not only help endure assembly location variability due to the previously described manufacturing tolerances, but also location variability of the first and second camshaft phasers 20, 30 during use of the IC engine. For example, axial and radial valve train forces that act on the inner camshaft 44 are likely different than axial and radial valve train forces that act on the outer camshaft 42, which can translate to unequal axial and radial movements of the first camshaft phaser 20 and the second camshaft phaser 30 that are connected to these respective components. In addition, a power transmission interface force that is applied to the drive wheel 34 of the second camshaft phaser 30, likely results in a different resultant motion and position of the second camshaft phaser 30 relative to the first camshaft phaser 20.

The coupling 80 and its associated interfaces with the first and second camshaft phasers 20, 30 can be modified for packaging purposes or to accommodate manufacturability. The coupling ring 88, as shown in FIG. 6A, is formed with an axial offset AO, however, other form features could also be present.

Figure 6C:
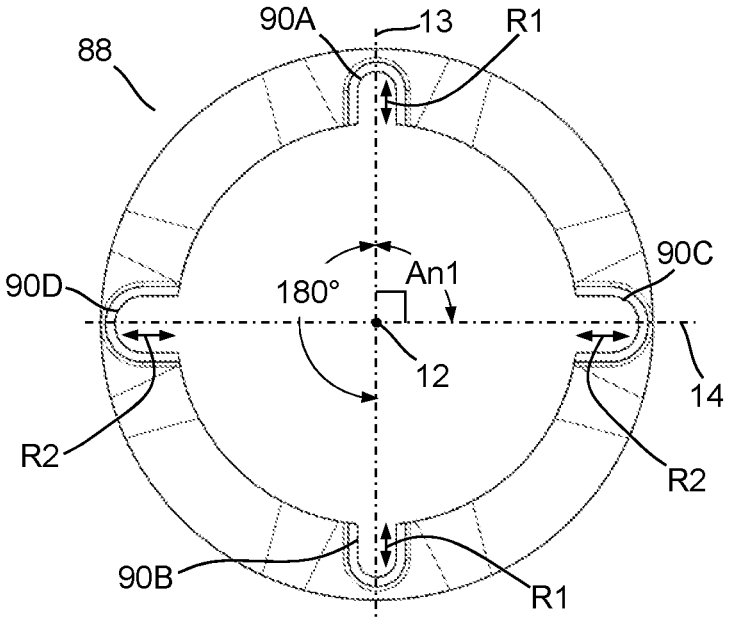
FIG. 6C is a rear view of the coupling ring shown in FIGS. 5 and 6A.

Referring to FIG. 6C, a center line 13 is shown for the first and second radial slots 90A, 90B and a center line 14 is shown for the third and fourth radial slots 90C, 90D. The two center lines 13, 14 form an angle An1. While the angle An1, as shown, is 90 degrees, it can have any magnitude to facilitate the previously described first and second radial movements R1, R2. Furthermore, while the figures show a total of four radial slots 90A, 90B, 90C, 90D, with the first and second radial slots 90A, 90B arranged in the first radially opposed pair, and the third and fourth radial slots 90C, 90D arranged in the second radially opposed pair, it could be possible to utilize only the first radial slot 90A and the third radial slot 90C to accommodate the first and second respective radial movements R1, R2. Therefore, it can be stated that the coupling ring 88 can be configured with at least one first radial slot (one or both of the first and second radial slots 90A, 90B) to accommodate the first radial movement R1, and at least one second radial slot (one or both of the third and fourth radial slots 90C, 90D) to accommodate the second radial movement R2.

Figure 10A:
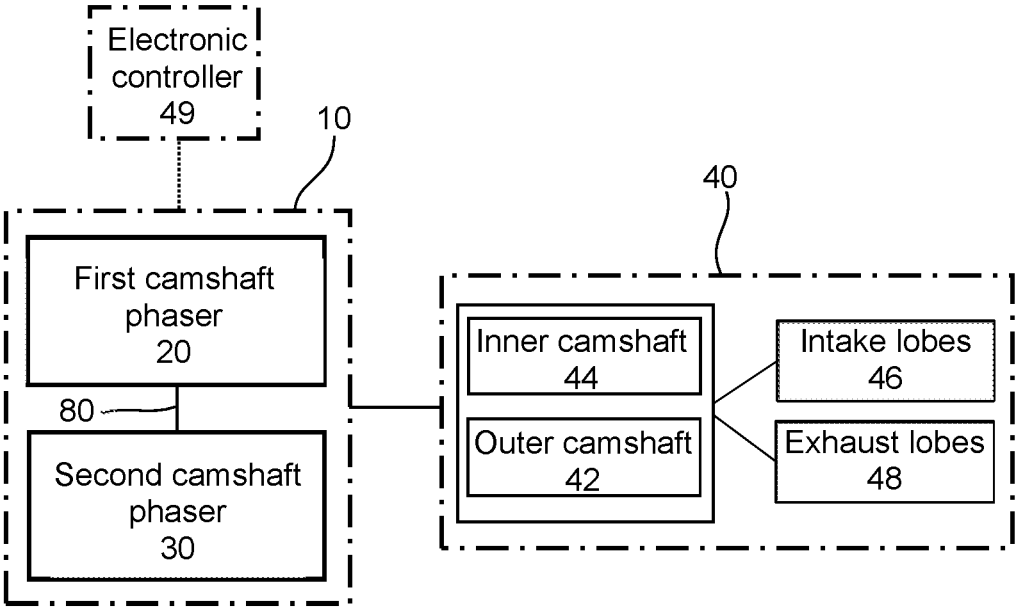
FIG. 10A is a schematic diagram of the camshaft phaser arrangement of FIG. 1 together with an electronic controller, depicting a flexible location of intake and exhaust camshaft lobes within the concentric camshaft assembly.

The camshaft phaser arrangement 10 for the concentric camshaft assembly 40 provides independent phasing of the inner camshaft 44 relative to the outer camshaft 42. Referring to FIG. 10A, a schematic diagram of the camshaft phaser arrangement 10 is shown together with an electronic controller 49, and the concentric camshaft assembly 40. The camshaft phaser arrangement 10 can be controlled by the electronic controller 49; this electronic controller 49 can possibly be an electronic control unit (ECU) that controls an IC engine. The concentric camshaft assembly 40 includes intake lobes 46 and exhaust lobes 48, each of which can be arranged on either the inner camshaft 44 or the outer camshaft 42. In some engine design instances, it may prove advantageous to have the outer camshaft 42 configured with the exhaust lobes 48 and the inner camshaft 44 to be configured with the intake lobes 46, however, this arrangement could also be reversed.

Figure 10B:
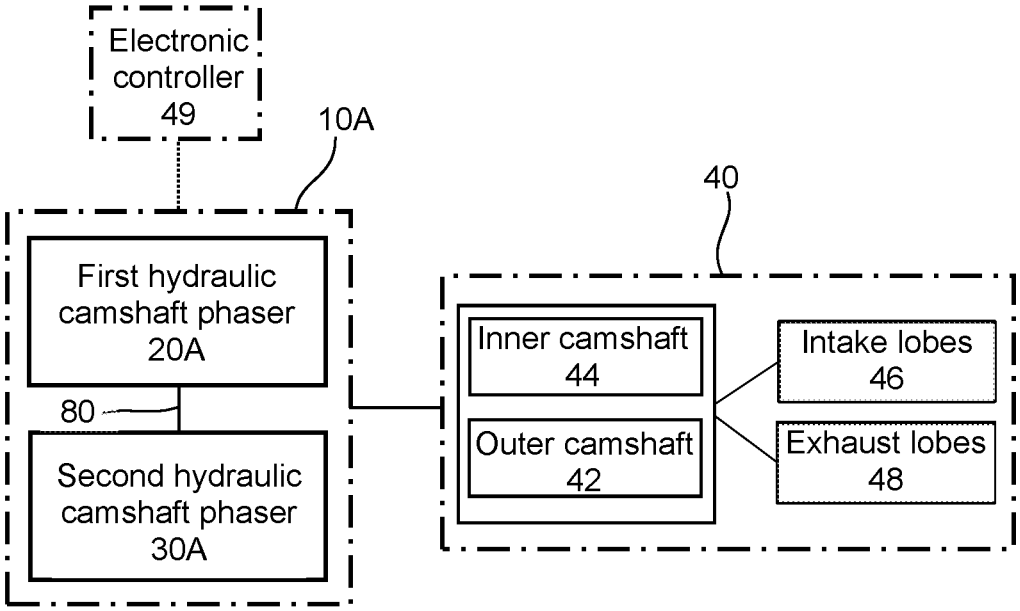
FIG. 10B is a schematic diagram of an example embodiment of a camshaft phaser arrangement with a first and a second hydraulically actuated camshaft phaser.

The first camshaft phaser 20 and second camshaft phaser 30 can be actuated hydraulically with hydraulic fluid such as engine oil, electrically with an electric motor, or by any other actuation means. FIGS. 1 through 4 show a first camshaft phaser 20 that is electrically actuated, and a hydraulically actuated second camshaft phaser 30. It could also be possible to have a hydraulically actuated first camshaft phaser and an electrically actuated second camshaft phaser. Furthermore, it could also be possible to have both camshaft phasers actuated in the same manner. In summary, the first and second camshaft phasers can include at least one of a hydraulic camshaft phaser or an electric camshaft phaser. Referring to FIG. 10B, a schematic diagram of a camshaft phaser arrangement 10A is shown together with an electronic controller 49 and the concentric camshaft assembly 40. The camshaft phaser arrangement 10A includes a first hydraulic camshaft phaser 20A and a second hydraulic camshaft phaser 30A. The first hydraulic camshaft phaser 20A is torsionally coupled to the second hydraulic camshaft phaser 30A by the coupling 80, and both camshaft phasers 20, 30 are electronically controlled by the electronic controller 49. While Figure LOB's camshaft phaser arrangement 10A shows hydraulically actuated first and second camshaft phasers 20A, 30A, utilizing first and second electrically actuated camshaft phasers could also be possible.

Referring to FIGS. 1 and 3, a first timing wheel 50 and a second timing wheel 60 are shown; the first timing wheel 50 is axially adjacent and concentric to the second timing wheel 60.

Figure 7:
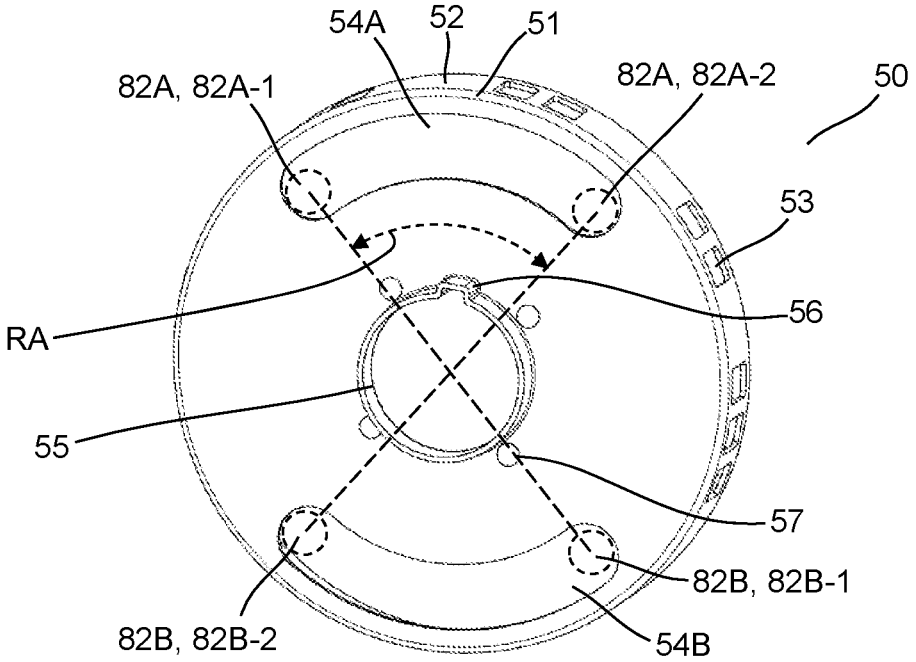
FIG. 7 is a perspective view of the first timing wheel of FIG. 1.
Figure 9A:
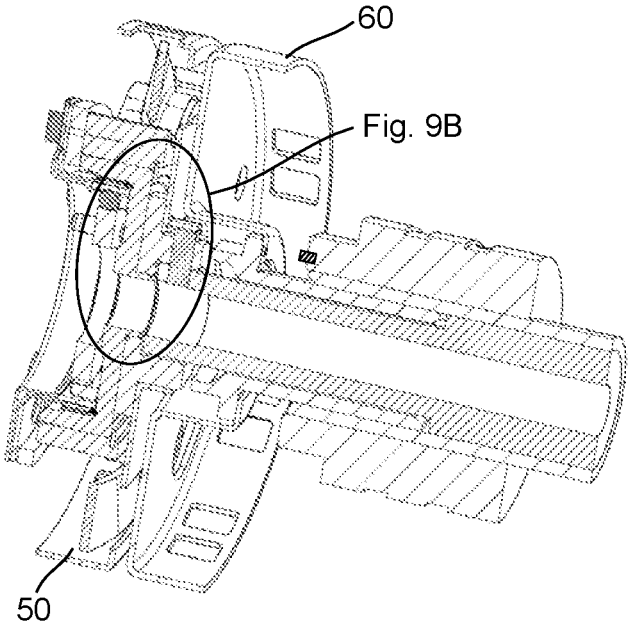
FIG. 9A is a cross-sectional perspective view of a portion of the camshaft phaser arrangement of FIG. 1.
Figure 9B:
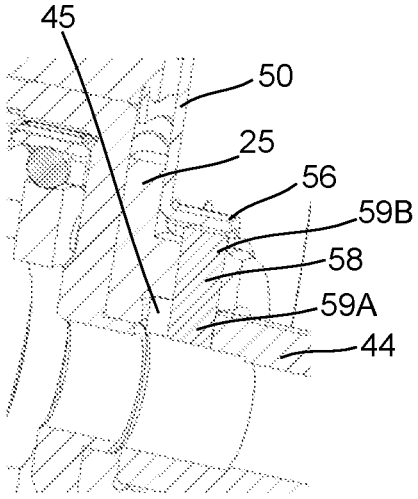
FIG. 9B is a detailed view taken from FIG. 9A.

Referring to FIG. 7 with view to FIGS. 1 through 4, a perspective view of the first timing wheel 50 is shown. The first timing wheel 50 includes a central bore 55, fastening apertures 57, a first cutout 54A, a second cutout 54B, and an outer edge 51 that defines a radial wall 52. The central bore 55 is connected to a central hub 25 of the first camshaft phaser 20 (FIG. 3), and the central hub 25 is connected to an output gear 27 (FIG. 4). The fastening apertures 57 can be used to secure the first timing wheel 50 to the central hub 25 with fasteners (not shown). Other attachment methods are also possible that would eliminate the use of fasteners such as clinching the first timing wheel 50 to the central hub 25. The central bore 55 is configured with a first orientation guide 56; proper rotational timing of the first camshaft phaser 20 with the inner camshaft 44 of the concentric camshaft assembly 40 is achieved when the first orientation guide 56 is aligned with a second orientation guide 58 arranged within the central hub 25. The second orientation guide can be received within a groove 45 formed within the inner camshaft 44, as shown in FIGS. 9A and 9B. The second orientation guide 58 is shown as an alignment pin having a first end 59A that is received by the groove 45 of the inner camshaft 44 and a second end 59B that is received by the first orientation guide 56. Other forms of the first and second orientation guides 56, 58 are also possible. It could also be possible to arrange the first orientation guide 56 at other locations within the first timing wheel 50, other than the central bore 55. As the first timing wheel 50 rotates about the rotational axis 12, the sensing windows 53 cooperate with a first camshaft position sensor 16 (see FIG. 1) to provide angular position of the inner camshaft 44 of the concentric camshaft assembly 40.

The first and second cutouts 54A, 54B provide space for the first and second coupling pins 82A, 82B due to phasing of the inner camshaft 44 that occurs relative to the stator 31 of the second camshaft phaser 30. As shown in FIG. 7, the first and second cutouts 54A, 54B have an angular span that can accommodate a rotational range of camshaft phaser authority RA for the first camshaft phaser 20; the rotational range of authority RA is defined as the additive advance and retard phasing capability, relative to a piston top-dead-center (TDC) position. For example, in an instance where timing of an engine valve can be advanced to a maximum of −40 degrees of camshaft rotation relative to TDC and retarded to a maximum of +10 degrees of camshaft rotation relative to TDC, the range of authority is 50 degrees of camshaft rotation. Thus, the first and second cutouts 54A, 54B have an angular span that can at least accommodate a range of authority of the first camshaft phaser 20. Stated otherwise, the first and second cutouts 54A, 54B have an angular span that can accommodate rotation of the first timing wheel 50 as the inner camshaft 44 is phased relative to the stator 31 (connected to the drive wheel 34) of the second camshaft phaser 30, the stator 31 connected to the first and second coupling pins 82A, 82B. Referring to FIG. 7, a first maximum rotational position 82A-1 of the first coupling pin 82A, and a first maximum rotational position 82B-1 of the second coupling pin 82B are shown. These first maximum rotational positions 82A-1, 82B-1 represent a maximum retarded rotational position of the inner camshaft 44. Also shown in FIG. 7 are a second maximum rotational position 82A-2 of the first coupling pin 82A and a second maximum rotational position 82B-2 of the second coupling pin 82B, that represent a maximum advanced position of the inner camshaft 44. For clearance and tolerance purposes, the angular span of the first and second cutouts 54A, 54B may be even larger than the range of authority RA for the first camshaft phaser 20.

Figure 8:
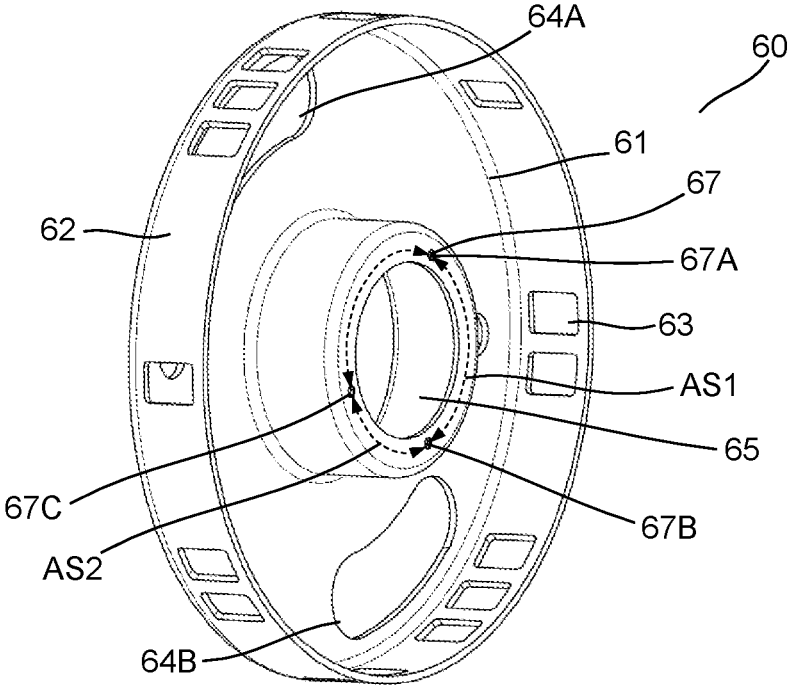
FIG. 8 is a perspective view of the second timing wheel of FIG. 1.

Referring to FIG. 8 with view to FIGS. 1 through 3, a perspective view of the second timing wheel 60 is shown. The second timing wheel 60 includes a central bore 65, fastening apertures 67, a first cutout 64A, a second cutout 64B, and an outer edge 61 that defines a radial wall 62. The second timing wheel 60 can be formed as a cupped disc, with the radial wall 62 defining sensing windows 63 that cooperate with a second camshaft position sensor 18 (FIG. 1) to provide angular position of the outer camshaft 42. As shown in FIGS. 1 and 3, the second timing wheel 60 can at least partially enclose a bias spring 94 of the second camshaft phaser 30. The second timing wheel 60 is attached to a rotor 36 of the second camshaft phaser 30 via fastening screws 68 inserted within the fastening apertures 67. As shown in FIG. 8, the fastening apertures 67 include a first fastening aperture 67A, a second fastening aperture 67B, and a third fastening aperture 67C, arranged in a poka-yoke or error-proofing pattern such that the second timing wheel 60 can only be attached to the rotor 36 in one orientation. The error-proofing pattern is made possible by unequally spaced first, second, and third fastening apertures 67A, 67B, 67C. A first angular space AS1 between the first fastening aperture 67A and the second fastening aperture 67B is not equal to a second angular space AS2 between the second fastening aperture 67B and the third fastening aperture 67C. Within FIG. 8, the first and second angular spaces AS1, AS2 are shown by broken lines for clarity purposes. After the second timing wheel 60 is attached to the rotor 36, the second camshaft phaser 30 (via the rotor 36) can be axially clamped to a journal bearing 38 which is attached to the outer camshaft 42. This clamping action is accomplished by the second camshaft fastener 72 that is received by the outer camshaft 42 via a threaded connection, interference fit, or any other suitable way to attach the second camshaft fastener 72 to the outer camshaft 42. To ensure proper timing or orientation of the second camshaft phaser 30 with respect to the outer camshaft 42, the journal bearing 38 is configured with a timing pin 43 that protrudes from an axial face 39 and is received by an aperture 37 in the rotor 36.

As with the first timing wheel, the first and second cutouts 64A, 64B of the second timing wheel 60 are configured to receive the coupling pins 82 that torsionally couple the first and second camshaft phasers 20, 30. An angular span of the first and second cutouts 64A, 64B can be equal to or greater than a range of authority of the second camshaft phaser 30.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first camshaft phaser configured to be connected to one of the inner or outer camshafts;

a second camshaft phaser configured to be connected to the other of the inner or outer camshafts;

the first camshaft phaser axially adjacent to the second camshaft phaser; and, a coupling arranged to torsionally connect the first camshaft phaser to the second camshaft phaser, the coupling comprising:

a coupling ring having:

at least one first radial slot configured to: (1) connect the coupling ring to one of the first or second camshaft phaser and, (2) provide for a first radial movement between the first camshaft phaser and the second camshaft phaser; and, at least one second radial slot configured to provide for: (1) a second radial movement between the first camshaft phaser and the second camshaft phaser, and (2) an axial movement between the first camshaft phaser and the second camshaft phaser; and, at least one coupling pin, a first end received by the at least one second radial slot, and a second end connected to the other of the first or second camshaft phaser.

2. The camshaft phaser arrangement of claim 1, wherein a pathway for the first radial movement is defined by the at least one first radial slot and a pathway for the second radial movement is defined by the at least one second radial slot.

3. The camshaft phaser arrangement of claim 1, wherein a diameter of the first end of the at least coupling pin is smaller than a width of the at least one second radial slot.

4. The camshaft phaser arrangement of claim 1, wherein a center line of the at least one first radial slot is perpendicular to a center line of the at least one second radial slot.

5. The camshaft phaser arrangement of claim 1, wherein the at least one first radial slot comprises a first pair of opposed radial slots, and the at least one second radial slot comprises a second pair of opposed radial slots.

6. The camshaft phaser arrangement of claim 1, further comprising at least one fastener that connects the coupling ring to the one of the first or second camshaft phaser.

7. The camshaft phaser arrangement of claim 6, further comprising at least one bushing that is connected to the one of the first or second camshaft phaser by the at least one fastener, the at least one bushing received by the at least one first radial slot.

8. The camshaft phaser arrangement of claim 7, wherein a length of a body of the at least one bushing is greater than a height of the at least one first radial slot.

9. The camshaft phaser arrangement of claim 8, wherein a diameter of the body of the at least one bushing is less than a width of the at least one first radial slot.

10. The camshaft phaser arrangement of claim 1, wherein at least one of the first or second camshaft phaser is an electric camshaft phaser or a hydraulic camshaft phaser.

11. The camshaft phaser arrangement of claim 1, wherein the coupling ring is formed with an axial offset.

12. The camshaft phaser arrangement of claim 1, wherein the coupling ring is connected to the first camshaft phaser and the second end of the at least one coupling pin is connected to the second camshaft phaser, the first camshaft phaser arranged axially outward of the second camshaft phaser.

13. The camshaft phaser arrangement of claim 12, wherein the coupling ring is connected to a non-phased component of the first camshaft phaser.

14. The camshaft phaser arrangement of claim 12, wherein the second camshaft phaser includes a drive wheel configured with a power transmission interface.

15. The camshaft phaser arrangement of claim 12, wherein the first camshaft phaser is an electric camshaft phaser, and the second camshaft phaser is a hydraulic phaser.

16. The camshaft phaser arrangement of claim 15, wherein the coupling ring is connected to an outer collar of the first camshaft phaser.

17. The camshaft phaser arrangement of claim 15, wherein the first camshaft phaser is configured to be connected to the inner camshaft, and the second camshaft phaser is configured to be connected to the outer camshaft.

18. The camshaft phaser arrangement of claim 15, wherein the second end of the at least one coupling pin is connected to a non-phased component of the second camshaft phaser.

19. The camshaft phaser arrangement of claim 15, wherein the second end of the at least one coupling pin is received by an aperture arranged within the second camshaft phaser.

20. The camshaft phaser arrangement of claim 19, wherein the aperture is arranged in a stator of the second camshaft phaser.

* * * * *